United States Patent [19]

Deckard

[11] 4,164,326

[45] Aug. 14, 1979

[54] ELECTROMAGNETIC FUEL INJECTOR NOZZLE ASSEMBLY

[75] Inventor: John I. Deckard, Grand Rapids, Mich.

[73] Assignee: General Motors Corporation, Detroit, Mich.

[21] Appl. No.: 894,099

[22] Filed: Apr. 6, 1978

[51] Int. Cl.[2] ..... F02M 41/16

[52] U.S. Cl. ..... 239/585; 239/453; 123/32 AE; 123/139 E

[58] Field of Search ..... 239/453, 585, 533.7–533.9, 239/96; 123/32 AE, 32 AB, 139 E

[56] References Cited

U.S. PATENT DOCUMENTS

| | | | |
|---|---|---|---|
| 3,450,353 | 6/1969 | Eckert | 239/585 |
| 3,610,529 | 10/1971 | Huber | 239/585 X |
| 3,623,460 | 11/1971 | Komaroff et al. | 123/32 |
| 3,680,782 | 8/1972 | Monpetit et al. | 239/585 X |
| 3,705,692 | 12/1972 | Garnier | 239/585 |
| 3,753,426 | 8/1973 | Lilley | 123/139 E |
| 3,802,626 | 4/1974 | Regneault et al. | 239/585 X |

*Primary Examiner*—Robert W. Saifer
*Attorney, Agent, or Firm*—Arthur N. Krein

[57] ABSTRACT

An electromagnetic fuel injector nozzle assembly has a pressure balanced poppet valve controlled discharge outlet supplied with pressurized fuel, with a return spring normally maintaining the poppet valve in a closed position. An actuator cylinder means and plunger is incorporated in the nozzle assembly with the actuator plunger positioned therein to engage the poppet valve to effect outward opening movement thereof and has its end of the actuator cylinder means opposite the poppet valve supplied with pressurized fuel for hydraulic actuation of the plunger, while the opposite end of the actuator cylinder means, the end adjacent to the poppet valve, is supplied with pressurized fuel through a flow control throttling orifice and this end of the actuator cylinder is also connected via a modulated pressure passage, having a normally closed solenoid valve therein for controlling flow therethrough, to a low pressure drain passage whereby when the solenoid valve is closed, fluid pressure on opposite ends of the actuator cylinder is substantially balanced whereby to permit seating of the poppet valve by the return spring, and when the solenoid valve is open, a force unbalance will occur across the actuator piston to effect hydraulic unseating of the poppet valve.

3 Claims, 4 Drawing Figures

ELECTROMAGNETIC FUEL INJECTOR NOZZLE ASSEMBLY

FIELD OF THE INVENTION

This invention relates to fuel injection apparatus and, in particular, to a poppet type electromagnetic fuel injector nozzle assembly for use in internal combustion engines, particularly, diesel engines.

DESCRIPTION OF THE PRIOR ART

Injection nozzles of the poppet valve type have been previously used for the injection of fuel into the cylinders on an internal combustion engine, such as a diesel engine. In such prior art poppet type fuel injection nozzles, the closure member of the valve is normally moved to its open position by the supply of pressurized fuel to be injected acting on the head of the valve and is normally moved to its closed position by a return spring operating on a shoulder of the valve at the inner end of the stem of the valve member when fuel pressure is reduced after some predetermined period of injection.

Such conventional poppet type fuel injection nozzles, since they are periodically supplied with pressurized fuel to effect injection, have a number of objectionable operating characteristics, such as little penetration of fuel into a combustion cylinder; variation in flow stability during injection; and, a rapid supply pressure drop through the fuel supply system to the injector and through the nozzle components of the injector assembly.

In an attempt to improve on such conventional poppet type fuel injection nozzles, various forms of electromagnetic devices have been incorporated into this type fuel injection nozzle in an effort to correct one or more of the above-described problems associated with this type fuel nozzle, but none of such modified nozzle assemblies have been operative to correct all of the above-described problems.

SUMMARY OF THE INVENTION

The present invention provides an electromagnetic fuel injector nozzle assembly of the poppet valve type that includes a hydraulic force balance system with a normally closed solenoid valve therein which is operative to control the opening and closing movement of the poppet valve and to thereby control the dynamic response characteristics of this unit.

It is, therefore, a primary object of this invention to provide an electromagnetic fuel injector nozzle assembly of the poppet valve type whereby movement of the poppet valve to its open position is controlled solely by a hydraulic actuator member with the hydraulic operation of the latter controlled by a solenoid valve.

Another object of this invention is to provide an improved electromagnetic fuel injector nozzle assembly of the poppet valve type for use in a diesel engine which is operative to provide for rapid poppet lift, with improved fuel penetration and injection stability.

A still further object of this invention is to provide an electromagnetic fuel injector nozzle assembly of the poppet valve type wherein the rate of injection from this assembly is controlled hydraulically by means of a hydraulic actuator controlling movement of the poppet valve.

For a better understanding of the invention, as well as other objects and further features thereof, reference is had to the following detailed description of the invention to be read in connection with the accompanying drawings.

Figure 1:
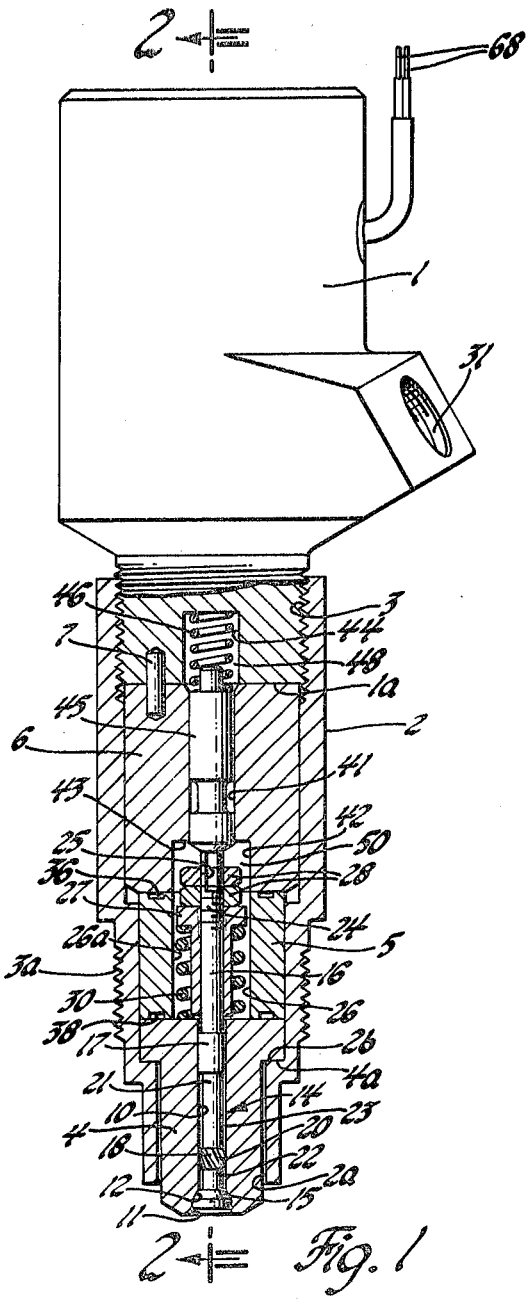
FIG. 1 is a longitudinal view of an electromagnetic fuel injector nozzle assembly in accordance with the invention, with parts thereof broken away to show internal operating elements of the assembly.
Figure 2:
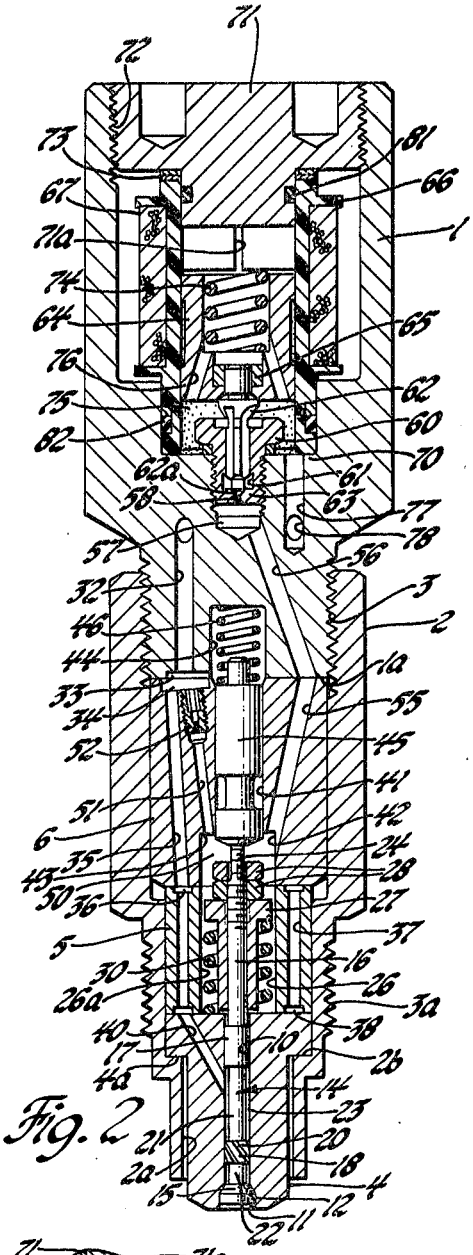
FIG. 2 is a longitudinal, sectional view of the structure of FIG. 1, this view being taken along line 2—2 of FIG. 1.
Figure 3:
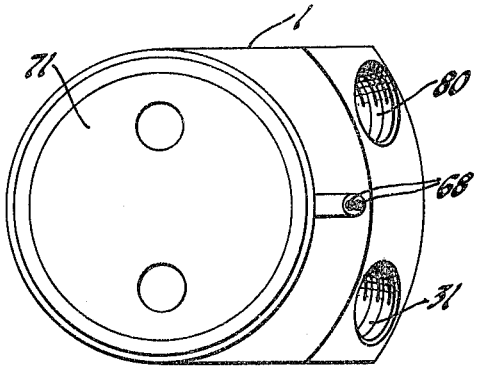
FIG. 3 is a top view of the injector nozzle assembly shown in FIG. 1.

Referring now to the drawings and in particular to FIGS. 1, 2 and 3, there is shown an electromagnetic fuel injector nozzle assembly, in accordance with the invention, that includes an elongated housing means provided by a body 1 and a hollow cylindrical nut valve 2 whose upper end is in threaded connection, as at 3, to the body 1, an intermediate section of the nut being provided with external threads 3*a*, in the construction shown, whereby this housing assembly may be secured to an engine cylinder, not shown. Nut 2 has an opening 2*a* at its lower end through which extends the lower or outlet end of a combined injector supply tip and valve body 4, hereinafter referred to as the valve body of the subject injector nozzle assembly. As shown, the valve body 4 is enlarged at its upper end to provide a shoulder 4*a* which seats on an internal shoulder 2*b* provided by the step bore in nut 2.

Between the valve body 4 and the lower surface 1*a* of the body 1 there is positioned, in sequence, starting from the valve body 4, a spring cage 5 and a control cage 6, these elements being formed in the construction illustrated, as separate elements for ease of manufacturing and assembling. The threaded connection 3 of the nut 2 to the body 1 holds the spring cage 5 and control cage 6 clamped and stacked end-to-end between the upper end of the valve body 4 and the lower surface 1*a* of body 1. All of these above-described elements have lapped mating surfaces whereby they are held in pressure sealed relation to each other and, in addition, dowels, such as dowel 7, are used to retain the desired, aligned, position of these elements relative to each other in a manner well known in the art.

Valve body 4 is formed with a stepped through bore to provide, in sequence, an internal annular wall 10 of predetermined internal diameter extending from the upper end of the valve body, with reference to FIGS. 1 and 2, and an internal annular wall 11, with a connecting conical shoulder or valve seat 12 therebetween, the wall 11 having an internal diameter greater than that of wall 10, with this wall 11 defining a spray outlet from the valve body 4 to the combustion chamber of an engine cylinder, not shown.

A poppet valve 14, which is reciprocably journaled in the stepped bore of valve body 4 to control fuel injection therefrom, includes an enlarged mushroom type head 15 of predetermined outside diameter with a valve stem 16 extending therefrom. Valve stem 16 is provided with axial spaced-apart lands 17 and 18, both of an outside diameter so as to be slidably received by the wall 10, but with the lower land 18 being provided with spaced-apart spiral grooves 20 therein. Valve stem 16 is also provided with predetermined reduced diameter portions 21 and 22 between lands 17 and 18 and between land 18 and head 15, respectively, to form with the wall 10 a fluid supply passage or chamber 23 in fluid communication with the outlet from the valve body 4 as controlled by the outward opening head 15 of the poppet valve.

At its upper end, valve stem 16, is of reduced diameter relative to the diameter of land 17 and the free end portion of valve stem 16, that is the end opposite head 15, is provided with external threads 24 and, is also provided with at least one through radial slot 25 at the free end thereof for insertion of a tool bit to prevent rotation of the poppet valve when the nuts 28, described hereinafter are threaded onto the valve stem. This upper end of the valve stem 16, in the construction shown, is of an axial length so as to extend upward through an internal axial through spring chamber 26 in spring cage 5 and into a cavity, to be described, in control cage 6.

Between the upper end of valve body 4 and an annular, radial flanged, spring retainer 27 encircling the upper portion of the valve stem 16 and biased into abutment against the lower of a pair of nuts 28 threadedly engaged on threads 24 is a compression valve return spring 30, of predetermined force, which serves to urge the head 15 of the poppet valve 14 upward, with reference to FIG. 1, to a closed position, as shown, with the upper, outer conical portion of head 15 in seated engagement with valve seat 12.

Fuel, as from a conventional fuel tank via a high pressure supply pump and conduit, not shown, is supplied to the fuel passage or chamber 23 in the valve body 4 through a supply passage means that includes an inlet fitting or port 31 in body 1 and a passage 32 in body 1 in communication in one end with the port 31 and at its opposite end with a recessed cavity 33 in the lower surface 1*a* of the body. This recessed cavity 33 opens into a recessed cavity 34 in the upper end of the control cage 6 which is in communication via an axial passage 35 in the control cage 6 and which, in turn, is in communication with an annular groove 36 at one or upper end of the spring cage 5 that is connected by one or more axial passages 37 to a second annular groove 38 at the opposite end of the spring cage and then via a drilled passage 40 in the valve body 4 opening into chamber 23, this drilled passage 40 intersecting or breaking out through the inner wall 10 at a suitable location below the land 17 when the poppet valve 14 is in its closed position so as to be in communication with chamber 23 when the poppet valve is open. With this arrangement, the chamber 23 can be continuously supplied with pressurized fuel, it being noted that this chamber 23 is located between the seal diameter of land 17 and the poppet valve head 15 as seated against valve seat 12 which are of the same effective diameter or area for pressure balance of the poppet valve. That is, the pressure of fuel within the chamber 23 is not intended to affect opening movement of the poppet valve 14.

Referring now to the control cage 6, it is provided with an axial stepped bore therethrough, providing, in sequence, an internal annular wall 41 extending from the upper end of the control cage 6 and an internal annular wall 42 of an enlarged internal diameter relative to that of wall 41, the internal diameter of wall 42 corresponding substantially to the internal diameter of the wall 26*a* defining the spring chamber 26 in spring cage 5, the walls 41 and 42 being interconnected by a radial wall 43. As shown, the stepped bore through the control cage 6 is concentric with the spring chamber 26 in spring cage 5 and the axis of the poppet valve 14, as journaled in the valve body 4, and it is also concentric with an enlarged recessed cavity 44 provided in the body 1 to extend upward from the lower surface la thereof.

An actuator plunger 45, of predetermined diameter is slidably journaled in a portion of the stepped bore of the control cage 6 provided in the internal wall 41 portion thereof, with one end of the valve actuator plunger 45 being positioned to abut against the free end of the valve stem 16 and with its opposite or reduced diameter end extending up into the cavity 44 to be encircled by a compression spring 46 which abuts at one end against the body 1 and its opposite end against the actuator plunger 45 whereby to normally bias the actuator plunger downward, with reference to FIGS. 1 and 2, into abutment with the upper or free end of valve stem 16. The force of this spring 46 is sufficiently less than that of the return spring 30 whereby the force of return spring 30 can effect forced seating of the poppet valve 14 against the bias of spring 46.

Figure 4:
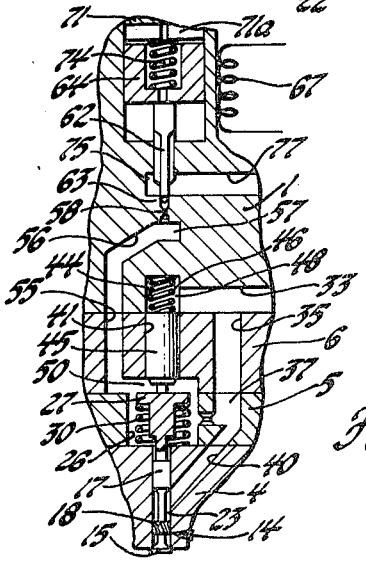
FIG. 4 is a schematic illustration of the primary operating elements of the electromagnetic fuel injector nozzle assembly in accordance with the invention.

As shown, the upper end of the actuator plunger 45 defines with internal wall 41 of control cage 6 and with the recessed cavity 44 in body 1 a variable volume pressure actuator chamber 48, as shown in FIG. 4, while the lower end of the actuator plunger 45 defines with the internal wall 42 and shoulder 43 of control cage 6 and with the spring chamber 26 in spring cage 5, a pressure control modulator chamber 50, as shown in FIG. 4.

Fuel at high supply pressure flowing in passage 32 is also supplied to the actuator chamber 48 as by having the cavity 44 interconnected to this passage 32 by means of the recessed cavity 33 which as shown in FIG. 2 has one side thereof opening into cavity 44 in the body 1. Fuel at high supply pressure from passage 32 is also supplied via recessed cavity 33 in body 1 and the recessed cavity 34 in control cage 6 to the modulator chamber 50 through a modulator flow passage 51 in the control cage 6 having a throttling orifice 52, these elements being positioned so as to be in fluid communication at one end with the recessed cavity 34 and having its opposite end opening through the radial wall 43 into the modulator chamber 50. The throttling orifice 52 is of a predetermined diameter, as desired, for a purpose which will become apparent hereinafter.

Modulation of the fuel pressure in the modulation pressure control chamber 50 is obtained by connection of this chamber via a pressure modulated passage means to a fuel drain passage means used for the discharge of fuel from the nozzle assembly at a reduced pressure, corresponding to substantially atmospheric pressure. In the construction illustrated, the pressure modulated passage means includes an outlet passage 55 from the control chamber 50, that is suitably provided, for example, in the control cage 6, one end of this passage 55 opening through the radial wall 43 and inner wall 42 into the modulator chamber 50 while its opposite end is connected in flow registration with a passage 56 in body 1 that opens into one end of a flow compartment or chamber 57 formed in the body 1 by a counterbored stepped opening extending from the upper end of this body.

Flow from the flow compartment of chamber 57 to the fuel drain passage means is controlled by a normally closed, solenoid actuated valve controlling flow through a metering orifice 58 provided in the modulated pressure passage means. In the construction illustrated, a valve cage 60, threadedly secured in the body 1 is provided with a stepped bored passage 61 therethrough having the metering orifice 58, of predetermined diameter, therein opening into the chamber 57, the enlarged internal diameter portion of passage 61 slidably receiving the fluted end of an electromagnetic or solenoid actuated valve 62 which has a valve tip **62*a* adapted to engage the valve seat 63 that encircles the portion of passage 61 adjacent to the metering orifice 58. The opposite end of valve 62 extends through the apertured end of a solenoid armature 64 and is fixed against axial movement relative thereto by an annular retainer 65 that, for example, is press fitted onto the stem end of the valve 62, that is, the end opposite valve tip 62*a***.

The armature 64 is slidably received in a tubular bobbin 66 which has a magnetic wire solenoid coil winding 67 wrapped around it that is connected by a pair of electrical leads 68 to a suitable source of electrical power via a conventional fuel injection electronic control circuit, now shown, whereby the solenoid can be energized as a function of operating conditions of the engine in a well known manner.

Bobbin 66 is positioned in the bore cavity adjacent to the top of the body 1 and is located between an inner shoulder 70 of the body 1 and a solenoid core pole 71 threaded at 72 to the internally threaded portion of the bore cavity in the body 1. The reduced diameter portion of the core or pole 71 with its cross-slotted free end **71*a* extends a predetermined axial distance into the bobbin 66 to serve as a stop for limiting axial movement of the armature 64 in one direction, upward as seen in FIG. 2, when the solenoid is energized, suitable shims 73 being positioned, as necessary, between the bobbin 66 and pole 71 to provide the desired necessary clearance for axial movement of the armature 64. As shown, the armature 64 and, therefore, the valve 62, are normally biased axially in the opposite direction, downward to the position shown in FIG. 2, by a compression spring 74 positioned in the recessed, open end of the armature 64, with one end of this spring in abutment against the slotted free end of the pole 71 and its opposite end engaging the armature 64**.

The interior of the bobbin 66 between the free end or upper end of the valve cage 60 and the one end of the armature 64 to which the valve 62 is attached, forms with these elements a fuel return chamber 75 that is in communication via axially extending passages 76 in armature 64 with the opposite or recessed, open end of the armature.

The fuel return chamber 75 forms part of a fuel drain passage means for the return of fuel to the fuel tank, not shown, used to supply fuel to this nozzle assembly, this drain passage means further including a passage 77 opening at one end into the lower end of chamber 75 through the shoulder 70, as best seen in FIG. 2, with its opposite end being connected via a return passage 78 in body 1 to a fuel outlet or drain fitting 80 in the body 1 which is adapted to be connected by a fuel drain conduit, not shown, to the fuel tank, not shown. Suitable seal means 81 and 82 are provided for sealing engagement between the bobbin 66 and core 71 and bobbin 66 and body 1, respectively.

Functional Description

Referring again to the drawings and in particular to FIG. 4, which schematically illustrates the primary operating elements of the subject injector nozzle assembly, fuel at a suitably high supply pressure Ps is continuously supplied from a fuel pump, now shown, to the injector nozzle via the inlet port 31. Fuel flows from the inlet port 31 through the inlet supply passage means including the passage 32, recessed cavities 33 and 34, the passage 35 and then via the annular grooves 36 and 38 and axial passage 37 to the drilled passage 40 to provide fuel at this supply pressure Ps in the fuel supply chamber 23. As previously described, the working area defined between the small diameter portion 21 and the land 17 of the poppet valve stem 16 is equal to the normal working area of the valve head 15 against which this fluid pressure acts whereby the poppet valve 14, when closed, is not acted upon by any substantial differential pressure as a result of pressurized fuel within the fuel supply chamber 23.

At the same time, this supply pressure Ps is directly applied to the actuator chamber 48 and at a controlled flow rate, fuel at the supply pressure Ps is throttled to the modulator chamber 50. The pressure of fuel within the modulator pressure control chamber 50 will vary, as described hereinafter and, accordingly, is identified as a modulating pressure Pm. This modulating pressure Pm during static conditions, as when the solenoid valve is not energized whereby the valve 62 is seated against the valve seat 63, will equal the supply pressure Ps. during this period of time, since the force of return spring 30 is preselected to be substantially greater than the value of the spring 46, and since the pressures acting on opposite ends of the actuator plunger 45 are equal and act on equal effective areas, the return spring 30 is operative to bias and hold the poppet valve 14 in a closed position, the position shown in FIGS. 1, 2 and 4.

However, when an electrical (current) pulse of finite characteristics and duration, as timed relative to engine operation in a known manner, is applied through the leads 68 to the coil winding 67, there is produced an electromagnetic field attracting the armature 64 to the pole 71 thereby raising the solenoid actuated valve 62 from the valve seat 63 to permit fluid flow through the modulated pressure passage means to the fuel drain passage means thus causing a drop in the pressure of fuel in the modulator pressure control chamber 50, this drop in fuel pressure within the modulator chamber 50 occurring at a rate determined by the desired preselected diameter ratio of the throttling orifice 52 and the metering orifice 58. Thus the fuel pressure Pm in modulator chamber 50 will drop and when it reaches at least a peselected pressure Po, a sufficient force unbalance with occur across the actuator plunger so as to allow the supply pressure Ps in the actuator chamber 48 to effect downward movement of the actuator plunger 45 against the bias of spring 30 to effect outward opening of the poppet valve 14. Upon the outward opening movement of the valve head 15 of the poppet valve away from the valve seat 12, fuel injection will occur. Rapid hydraulic lift of the poppet valve 14 allows the maximum pressure Ps to be injected from the subject nozzle assembly, that is, the pressure of fuel in the supply chamber 23 will remain at substantially supply pressure Ps adjacent to the valve seat 12, this pressure thus providing for increased fuel injection penetration, and uniform flow during injection, since there will be little, if any, drop in the supply pressure Ps through the supply lines and nozzle components during injection.

Termination of the electrical pulse to the coil winding 67 causes a collapse of the electromagnetic force between the core 71 and armature 64 whereby the spring 74 is again operative to effect closure of the solenoid actuated valve 62. The force of the spring 74 is preferably preselected so as to provide a fast response closure of the valve 62 causing the modulation pressure to again rise in the modulator chamber 50 and, when this pressure Pm reaches a predetermined pressure equal to a closing pressure Pc, the return spring 30 will again be operative to effect closure of the poppet valve 14. Thereafter the modulator pressure Pm will again reach a pressure of Ps so that a hydraulic force balance equilibrium will again be in affect across the actuator plunger 45 with spring 30, of course, holding the poppet valve 14 in its closed position, as shown.

In contrast to conventional poppet type fuel injector nozzles, in the subject electromagnetic fuel injector nozzle assembly, the poppet valve 14 opening fuel pressure Po is equal to the fuel pressure Pc required to effect its closing, since, as previously described, the pressure of fuel in the fuel supply chamber 23 acts in opposite directions of equal effective working areas of the poppet valve.

The embodiments of the invention in which an exclusive property or privilege is claimed are defined as follows:

1. An electromagnetic fuel injector nozzle assembly including a housing means with a cylinder means therein and an axial bore passage interconnected at one end with said cylinder means and terminating at its opposite end at a spray outlet port at one end of said housing means, a poppet valve positioned in said bore passage for movement between a closed position and an open position relative to said spray outlet port for controlling fuel injection therefrom, an actuator plunger reciprocably journaled in said cylinder means in position to abut against one end of said poppet valve, a first spring means positioned in one end of said cylinder means to normally bias said actuator plunger into abutment with said poppet valve, a second spring means positioned in the opposite end of said cylinder means and operatively connected to said poppet valve for normally biasing said poppet valve to said closed position against the force of said first spring means, fuel supply passage means operatively connectable at one end to a source of high pressure fuel and connected in flow communication with said bore passage whereby to supply fuel for flow out through said spray outlet port, the fuel supply passage means also being in fluid flow communication with said one end of said cylinder means for continually supplying high pressure fuel against said one end of said actuator plunger, a throttle control orifice passage connected to said fuel supply passage means and to said opposite end of said cylinder means for supplying at a control flow rate fuel at high pressure to said opposite end of said cylinder means, a normally closed solenoid valve controlled drain passage means connectable at one end to a reservoir for fuel at substantially atmospheric pressure and connected at its opposite end to said opposite end of said cylinder means for the drain flow of fuel therefrom as controlled by said solenoid valve whereby the pressure of fuel in said opposite end of said cylinder means can be modulated between a low pressure and a high pressure to thereby vary the differential pressure across said actuator plunger between a high differential pressure when said solenoid valve is energized so as to effect movement of said actuator plunger in a direction to move said poppet valve to said open position and, a low differential pressure when said solenoid valve is de-energized whereby to provide a substantial force balance across said actuator plunger so that said second spring means is operative to move said poppet valve to said closed position.

2. An electromagnetic fuel injector nozzle assembly including a housing means with an axial bore passage therein terminating at a spray outlet port at one end of said housing, a poppet valve journaled for reciprocable movement in said bore passage between a closed first position to which the valve head of said poppet valve blocks flow out through said outlet port and an open second position at which said valve head is spaced outward from said outlet port to permit fuel discharge, a pressure chamber and a spring chamber in said housing in communication with each other, said spring chamber also being in communication at one end with said bore passage, a return spring means positioned in said spring chamber and operatively connected to said poppet valve for normally biasing said poppet valve to said closed first position, a poppet valve actuator plunger reciprocably journaled in said pressure chamber and having one end thereof positioned for abutment against the opposite end of said poppet valve from said valve head, a second spring means positioned in one end of said pressure chamber to normally bias said poppet valve actuator plunger into abutment against said poppet valve, an inlet in said housing means operatively connectable to a source of high pressure fuel, a fuel passage means in said housing connected at one end to said inlet and at its opposite end in flow communication with bore passage for supplying high pressure fuel to said bore passage for discharge out through said outlet port when said poppet valve is moved to said second position, said fuel supply passage means also being in flow communication to said one end of said pressure chamber containing said spring means whereby to apply a first force against one end of said poppet valve actuator plunger for affecting movement of said poppet valve to said second position, a throttle orifice passage in fluid communication at one end with said passage means and at its other end with the opposite end of said pressure chamber whereby to apply a second force against the opposite side of said poppet valve actuator plunger and to said opposite end of said poppet valve and, a solenoid valve controlled drain conduit means connected at one end to said opposite end of said pressure chamber and connectable at its opposite end to a reservoir containing fuel at atmospheric pressure, said solenoid valve being operable to control the drainage of fuel from said opposite end of said pressure chamber whereby said second force acting against the opposite end of said poppet valve actuator plunger can be modulated between a low value and a high value for controlling movement of said actuator plunger.

3. An electromagnetic injector including a housing means having a fuel inlet and a fuel drain outlet, said housing means including a valve body at one end thereof having an outlet port at its free end, fuel passage means connected at one end to said fuel inlet and terminating at its other end at said outlet port, a pressure chamber and a connecting spring chamber in said housing means, a poppet valve, having a head with a valve stem extending therefrom, journaled in said valve body with a portion thereof extending through an outlet port end portion of said passage means, said head of said poppet valve being thereby positioned for movement between a first position blocking flow out through said outlet port and a second position permitting flow out through said outlet port, said valve stem of said poppet valve having its free end projecting into said spring chamber, a first spring means of a first predetermined spring rate positioned in said spring chamber and operatively connected to said poppet valve to normally bias said poppet valve to said first position, a plunger reciprocably journaled in said pressure chamber, a second spring means of a second predetermined spring rate positioned in said pressure chamber to engage one end of said plunger whereby to normally move said plunger in a direction so that its opposite end abuts against said free end of said valve stem, a passage connecting said passage means in fluid communication to said pressure chamber on the end thereof containing said second spring means, a throttle orifice passage means connecting said passage means in fluid communication to said spring chamber, conduit means including a metering orifice connecting said spring chamber to said fuel drain outlet and, solenoid actuated valve means operatively associated with said conduit means to control flow through said metering orifice of said conduit means from said spring chamber to said fuel drain outlet whereby fuel pressure in said spring chamber can be reduced, as controlled by said solenoid actuated valve means, so that the pressure of fuel in said pressure chamber together with the force of said second spring means acting on said plunger will cause said plunger to effect movement of said poppet valve to said second position against the bias force of said first spring means.

* * * * *